United States Patent [19]

Gonon et al.

[11] Patent Number: 4,929,190

[45] Date of Patent: May 29, 1990

[54] INSULATION DISPLACEMENT CONNECTOR

[75] Inventors: Jean-Louis Gonon; Pierre Moulin, both of Saint-Marcellin, France

[73] Assignee: Arnould Fabrique d'Appareillage Electrique, Saint-Marcellin, France

[21] Appl. No.: 256,859

[22] Filed: Oct. 12, 1988

[30] Foreign Application Priority Data

Oct. 13, 1987 [FR] France ..... 87 14105
Jun. 24, 1988 [FR] France ..... 88 08509

[51] Int. Cl.[5] ..... H01R 4/24
[52] U.S. Cl. ..... 439/409; 439/391
[58] Field of Search ..... 439/389–419

[56] References Cited

U.S. PATENT DOCUMENTS 2,908,884 10/1959 Wirsching .
3,140,909 7/1964 Danesi .
4,705,340 11/1987 Loose ..... 439/395
4,781,618 11/1988 Geib et al. ..... 439/417
4,795,363 1/1989 Scherer et al. ..... 439/395

FOREIGN PATENT DOCUMENTS 0002113 5/1979 European Pat. Off. .
0179579 4/1986 European Pat. Off. .
3701274 7/1987 Fed. Rep. of Germany .

*Primary Examiner*—David Pirlot
*Attorney, Agent, or Firm*—Charles E. Brown; Charles A. Brown

[57] ABSTRACT

An insulation displacement connector comprises an insulative material body in which is a generally tubular metal contact member. This includes two at least part-cylindrical shell members of which one is a floating shell member and extends circumferentially cantilever fashion from a root generatrix. It is elastically deformable in the radial direction relative to this root generatrix. Respective inner and outer lips on the shell member define a slit extending around at least part of the circumference of the contact member. A barrel member rotatable about an axis of the connector forces an electrical conductor into the slit. At least in an unstressed condition of the connector, there is peripheral clearance between the floating shell member and the insulative material body.

27 Claims, 4 Drawing Sheets

INSULATION DISPLACEMENT CONNECTOR

BACKGROUND OF THE INVENTION

1. Field of the invention

The present invention is generally concerned with insulation displacement connectors, meaning connectors adapted to be fitted to an electrical conductor with an insulative sheath without previously baring its conductive core, whether this is to connect electrically an electrical conductor of this kind to equipment of any kind to serve the latter, the connector then serving simply as a connecting terminal, or to interconnect electrically a plurality of such electrical conductors.

2. Description of the prior art

The invention is more particularly directed to insulation displacement connectors which, as disclosed in published French patent application Ser. No. 2 593 969, filing date 2 Feb. 1986, comprise an insulative material body and in the body a generally tubular metal contact member having inner and outer lips and a slit defined by the inner and outer lips extending around at least part of the circumference of the contact member and a barrel member rotatable about an axis of the connector and adapted to force an electrical conductor into the slit in the contact member.

When the barrel member is rotated for this purpose, the lips of the slit displace the insulative sheath locally to bare the electrical conductor which is forced between them until contact is made with its conductive core.

One of the problems to be overcome in the practical implementation of insulation displacement connectors of this type arises from the fact that, for obvious reasons of standardization, they should be able to accommodate, at least within a certain range, electrical conductors of different diameters under satisfactory conditions of use and functioning, and that they should also be optionally reusable for any such electrical conductors.

In some at least of the embodiments shown in the aforementioned French patent application the contact member, which is in the form of a machined bush, has some flexibility because it is slit longitudinally and transversely to this end.

However, this flexibility of the contact member is exploited only to allow the lower part of the barrel member to pass through when fitting the latter.

Once the assembly is in place in the housing, the contact member is braced by the housing.

The same applies where, as in other embodiments, the contact member is formed by cutting and bending and has an S-shaped structure.

A general object of the present invention is an arrangement whereby further benefit can be derived from the flexibility of the contact member.

SUMMARY OF THE INVENTION

The present invention consists in an insulation displacement connector comprising an insulative material body and in said body a generally tubular metal contact member including two at least part-cylindrical shell members of which one is a floating shell member and extends circumferentially cantilever fashion from a root generatrix and is elastically deformable in the radial direction relative to said root generatrix, respective inner and outer lips on said shell members, a slit defined between said inner and outer lips and extending around at least part of the circumference of said contact member, and a barrel member rotatable about an axis of said connector and adapted to force an electrical conductor into said slit, wherein at least in an unstressed condition of said connector there is peripheral clearance between said floating shell member and said insulative material body.

Because of the ability of the floating shell member to deform elastically, an insulation displacement connector made in this way can advantageously accommodate electrical conductors of different diameters, in a ratio of as much as one to two.

In one specific embodiment the floating shell member of the contact member has a dimension of height (parallel to the connector axis) that decreases in the direction towards its free end.

In this way its capacity for elastic deformation advantageously varies along its circumferential length, being greater at its free end, that is to say at the V-shaped inlet to the slit, than at the opposite end.

In other words, for controlling the capacity of the floating shell member for elastic deformation and thus for adjusting the latter optimally to suit a range of different dimensions of the electrical conductors concerned, it is advantageously possible in this way to add two parameters to that consisting in the thickness of the floating shell member; these are, on the one hand, its root height at its root generatrix and, on the other hand, its height at its free end.

According to a first development of this arrangement, the floating shell member extends freely over part of the height of its root generatrix on the side of the lip that it forms.

In other words, the root area of this floating shell member, materialized in practise by a bending line joining it to a flange with which it is in one piece, extends over only part of its height from its root generatrix and beyond this, that is to say at the lip that it forms, the shell member extends freely.

The advantageous result of this is to add a further parameter for controlling the capacity of the floating shell member for elastic deformation.

According to a second development of this arrangement, the floating shell member includes at least one localized projecting tang through which it is adapted to bear against a wall of the insulative material body.

By virtue of such bearing the capacity of the floating shell member for elastic deformation is locally modified.

In this way it is advantageously possible to achieve even better control the evolution of this capacity for elastic deformation along the floating shell member.

Given such control, the insulation displacement connector in accordance with the invention can advantageously accommodate electrical conductors of different diameters, under good conditions of use and functioning, and can be reused for any such conductor.

The rotation torque to be applied to the barrel number for such use is also well controlled, without any risk that this rotation torque could exceed the mechanical strength of the barrel and so damage it.

Another object of the present invention is an arrangement whereby, conjointly with the variable capacity for elastic deformation of the floating shell member, the conditions under which the lip of the floating shell member and that of the other shell member interact with an electrical conductor may be varied.

To this end, the lips are joined to the respective shell members of which they form part by a radially narrower part on each shell member which reduces the distance between them and, at the free end of the floating shell member, they are conjointly bevelled from the base of this narrower part.

As a result, at the leading end of the slit, that its to say at its V-shaped inlet, the lips come into contact with an electrical conductor through a sharp edge particularly well suited to cutting the insulative sheath, whereas at the opposite end of this slit they interact with the electrical conductor only through a cylindrical surface the axis of which is parallel to the axis of the connector, which advantageously protects the conductive core of the electrical conductor, which has been bared before it reaches this point.

Thus at the free end of the floating shell member, where its capacity for elastic deformation is the highest and the contact pressure therefore the lowest, an electrical conductor is advantageously engaged by a sharp edge whereas, at the opposite end of the floating shell member, where its capacity for elastic deformation is the lowest and the contact pressure therefore the highest, contact with the conductive core of the electrical conductor is advantageously made through a cylindrical surface and therefore along a straight line in the axial direction.

The characteristics and advantages of the invention will emerge from the following description given by way of non-limiting example only with reference to the appended diagrammatic drawings.

DESCRIPTION OF THE PREFERRED EMBODIMENTS

Figure 1:
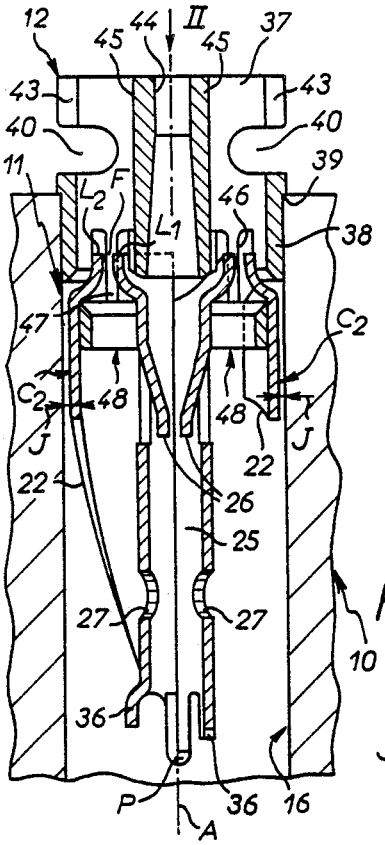
FIG. 1 is a partial view in axial cross-section of an insulation displacement connector in accordance with the invention.
Figure 3:
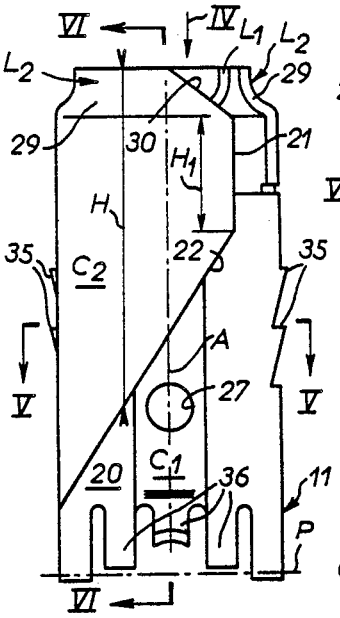
FIG. 3 is a view in elevation of the contact member that this insulation displacement connector comprises.

As shown in the figures and in a way that is known per se the insulation displacement connector in accordance with the invention generally comprises in an insulative material body 10 a generally tubular metal contact member 11 including at least two lips L1, L2 (an inner lip and an outer lip) defining between them a slit F extending circumferentially around the axis A of the connector over at least part of its circumference and a barrel member 12 rotatable about said axis A schematically represented in dashed line or by its location in some of the figures and adapted to force an electrical conductor 13 having a conductive core 14 and an insulative sheath 15 into the slit F of the contact member 11.

As the insulative material body 10 does not form part of the present invention it will not be described in detail here.

It will suffice to indicate that it is made from a synthetic material, for example, and that in order to accommodate an insulation displacement connector in accordance with the invention it includes a cylindrical housing 16 the transverse contour of which is circular and the axis of which is coincident with the axis A of the insulation displacement connector.

The insulative material body 10 may of course include a plurality of housings 16 parallel to each other and/or aligned with each other.

For example, it may form part of the casing of electrical equipment of any kind or itself form an independent casing.

Figure 12:
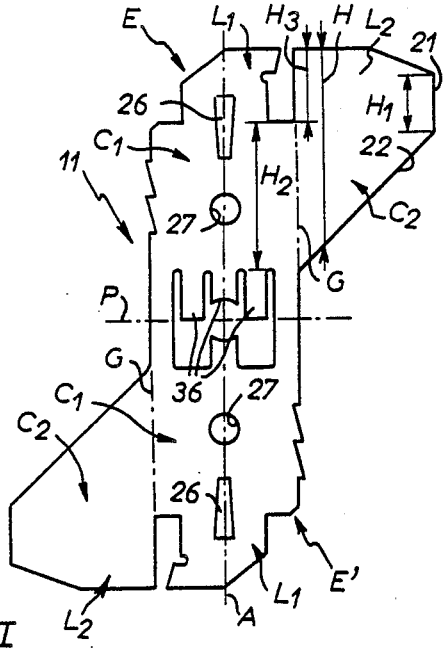
FIG. 12 is a plan view to a smaller scale of a blank from which this contact member is formed.

The contact member 11 is made in one piece from a single blank shown separately when flat in FIG. 12 by cutting and bending. It is formed of two identical elements E, E' symmetrical to each other relative to the axis A and joined to each other at their base at a bending line P transverse to the axis A.

The bending line P is also schematically represented in dashed line or by its location in some of the figures.

From this bending line P the two elements E, E' constituting the contact member 11 are in back-to-back relationship to each other through a flange 20 extending to either side of the axis A.

As the two elements E, E' are identical only one of them (element E) will be described in more detail now.

The two lips L1, L2 that it comprises to define a slit F form parts of respective shell members C1, C2 each of which is at least part-cylindrical overall and at least one of which, referred to hereinafter for convenience only as the floating shell member, extends circumferentially cantilever fashion from a root generatrix and is therefore elastically deformable in the radial direction about this root generatrix.

In the embodiment shown here the floating shell member is the outer shell member C2, that is to say the shell member of which the outer lip L2 forms part.

As previously explained the floating shell member C2 extends circumferentially cantilever fashion from a root generatrix G.

Over at least part of its height the root generatrix G is materialized by a bending line through which the floating shell member C2 is joined in one piece with the corresponding flange 20 along one of the edges of the latter and which therefore constitutes so to speak the area in which the floating shell member C2 is rooted on the flange 20.

In the embodiments shown in FIGS. 1 through 20 the floating shell member C2 has parallel to the axis A of the connector and over at least part of its circumferential length a height dimension H which decreases towards its free end 21, that is to say in the direction towards its end circumferentially opposite its root generatrix G.

The height H of the floating shell member C2 decreases regularly from its root generatrix G to its free end 21.

In other words, the initially straight edge 22 of the floating shell member C2 opposite the lip L2 that it forms extends in a helix in a plane oblique to the axis A of the connector.

In the embodiment shown here the floating shell member C2 still has some height H1 at its free end 21.

In other words, it does not extend to a point at this free end 21.

By virtue of the arrangements as described so far and ignoring the lip L2 that it forms the floating shell member C2 has when developed flat as shown in FIG. 12 a globally trapezium-shaped contour, to be more precise a contour in the shape of a right trapezium of which its root generatrix G forms the longer parallel side, its free end 21 forms the shorter parallel side and the edge 22 opposite the lip L2 forms the oblique side.

In this embodiment the floating shell member C2 also extends freely over part of the height of its root generatrix G at the lip L2 that it forms.

In other words, the bending line materializing this root generatrix G extends over only a part or portion H2 of the height of the latter, the floating shell member C2 thereafter extending cantilever fashion over a height H3 beyond the bending line, on the same side as the lip L2.

The floating shell member C2 therefore extends circumferentially over a portion of a cylinder subtending an angle between 90° and 180°.

The free end 21 of the floating shell member C2 therefore defines with the flange 20 from which it originates a free space 24.

The associated shell member C1 subtends an angle of 180°, being formed in practise by a simple half-wave shaped deformation of the central area of the flange 20.

The two shell members C1 of the two elements E, E' of the contact member 11 made in this way therefore and conjointly form a tubular receptacle 25 coaxial with the axis A of the connector that may be used for axial insertion into the contact member 11 of any kind of test plug, a banana type plug, for example.

For the purpose of cooperation with any such test plug there is cut out from each of the shell members C1 a tang 26 which, after it has been appropriately deformed, projects radially into the tubular receptacle 25 and is elastically deformable.

Aligned holes 27 are provided transversely in the shell member C1 for passing a tool through during manufacture and assembly of the connector.

There will now be described in more detail the lips L1, L2 defining the slit F included symmetrically in each of the elements E, E' constituting the contact member 11 in this embodiment.

In the embodiments shown in FIGS. 1 through 20 the lips L1, L2 are joined to the respective shell members C1, C2 of which they form part by a narrower part 29 which affects both the shell members C1, C2 in the radial direction and reduces the distance between them; at the free end 21 of the floating shell member C2 the lips L1, L2 are conjointly bevelled by means of a chamfer 309 from the base of the narrower part 29.

Because of the narrower parts 29 the lips L1, L2 are nearer each other than are the shell members C1, C2 of which they form part.

In the axial direction each of the narrower parts 29 occupies substantially a quarter-circle.

The lips L1, L2 extend substantially cylindrically beyond the narrower parts 29.

Through the conjunction of the toroidal shape due to the narrower parts 29 and the bevel due to the chamfer 30 the lips L1, L2 defining a slit F in a contact member 11 in accordance with the invention conjointly form at the leading end of the slit F a V-shaped inlet 31.

Figure 9:
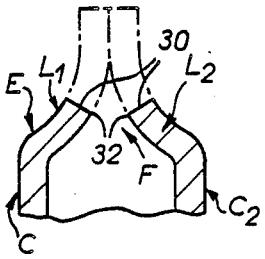
FIGS. 9 and 10 are partial views of this contact member, to be more precise the lips that it comprises, to a larger scale and in axial cross-section on the lines IX—IX and X—X, respectively, in FIG. 4.
Figure 10:
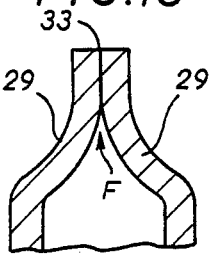

For the same reason, and as shown in FIGS. 9 and 10 in particular, they first feature in the V-shaped inlet 31 of the slit F corresponding to the chamfer 30 a sharp edge 32 (FIG. 9) and then a cylindrical surface 33 parallel to the axis of the connector (FIG. 10) beyond the V-shaped inlet 31.

The edge of the lips L1, L2 is offset inwardly relative to the axis A of the connector along the chamfer 30 and therefore in the V-shaped inlet 31.

It then gradually straightens until it is finally straight and substantially perpendicular to the axis A.

As an alternative to this, however, this edge could equally well be straight at all points along and beyond the chamfer 30, substantially perpendicular to the axis A.

The free edge of the lips L1, L2 of a slit in the contact member 11 in accordance with the invention is initially oblique relative to the axis A of the connector at the same end as the free end 21 of the floating shell member C2 in the corresponding V-shaped inlet 31 and is thereafter straight, lying in a plane transverse to the axis A.

As already mentioned the lips L1, L2 are extended axially by a cylindrical surface 33 beyond the narrower part 29 which joins them to the shell members C1, C2 of which they form part.

Over at least part of their circumferential length from the root generatrix G of the floating shell member C2 they are therefore parallel to the axis of the connector along their free edge.

However, the corresponding cylindrical surface 33 may be of a greater or lesser axial size.

It may even be reduced to a single circumference.

Barbs 35 are provided on the edge of the flanges 20 for anchoring the resulting contact member 11 into the housing 16 of the insulative material body 10.

Finally, in the embodiments shown in FIGS. 1 through 20 there are also provided at the base of the contact member 11 tangs 36 for making any kind of transverse connection to any kind of electrical conductor.

This arrangement does not form part of the present invention and will not be described here.

The barrel member 12 comprises a head 37 for rotating it, a shank 38 through which it is rotatably inserted into the housing 16 of the casing 10 and a transverse shoulder 39 bearing against the outside surface of the latter.

The head 37 is separated laterally from the shank 38 by notches 40. For rotating it it comprises on its surface an elongate diametral slot 41 parallel to the notches 40.

The diametral slot 41 is extended in the radial direction at its ends by lugs 42 which can also be used to rotate it.

The head 37 of the barrel member 12 further comprises two notches 43 each in line with a respective notch 40 and in cruciform arrangement with the slot 41.

An axial bore 44 in the barrel member 12 provides access to the tubular receptacle 25 formed by the contact member 11.

It further comprises at least one hole 45 parallel to the bore 44 for inserting an electrical conductor 13.

In a way that is known per se it also incorporates over at least part of its circumference at the base of its shank 38 a thin circular wall 46 through which it is adapted to extend axially into a slit F on the contact member 11 and which includes at least locally an opening 47 continuous with the aforementioned hole 45 for an electrical conductor 13 to pass through.

Since as previously explained the contact member 11 in practise comprises two slits F the barrel member 12 comprises two parallel holes 45 in diametrally opposed relationship to each other, each on a respective side of the slot 41 in its head 37 and in cruciform relationship thereto, and the thin wall 46 which extends it incorporates two openings 47 in corresponding relationship.

In the embodiments shown in FIGS. 1 through 20 the barrel member 12 finally comprises in a way that is known per se an axial extension 48 of each of its holes 45 beyond its thin wall 46.

This extension 48 forms a section of tube aligned with the corresponding hole 45.

Each of the tubular extensions 48 that the barrel member 12 incorporates is continuous with the thin wall 46 thereof and forms a localized excrescence on the thin wall 46, projecting radially inwards and radially outwards relative thereto, as if the thin wall 46 were locally split to form the tubular extensions 48.

The wall delimiting a tubular extension 48 is crescent-shaped and has virtually no thickness along that of its generatrices which is radially innermost relative to the thin wall 46.

The outside surface of each tubular extension 48 is adapted to brace internally the corresponding floating shell member C2 of the contact member 11.

Figure 4:
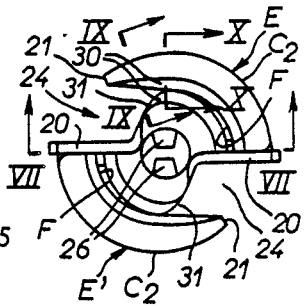
FIG. 4 is a plan view of this contact member in its unstressed configuration, as seen in the direction of the arrow IV in FIG. 3.
Figure 6:
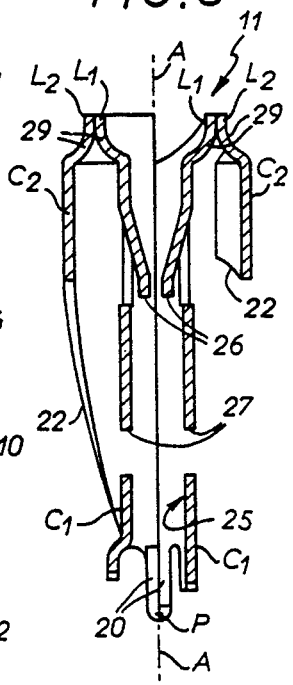
FIG. 6 is a view of it in axial cross-section on the line VI—VI in FIG. 3.
Figure 5:
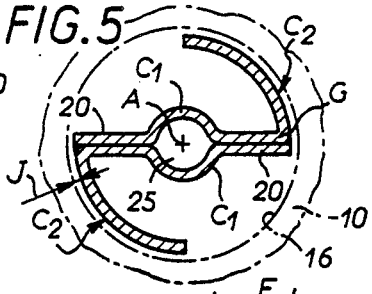
FIG. 5 is a view of it in transverse cross-section on the line V—V in FIG. 3.
Figure 2:
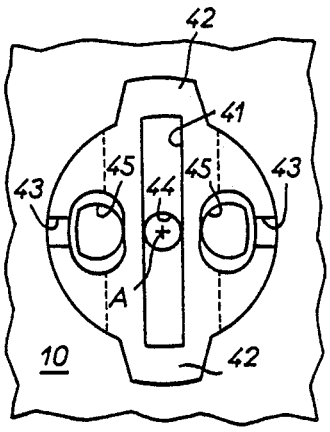
FIG. 2 is a partial plan view of it in the direction of the arrow II in FIG. 1.
Figure 7:
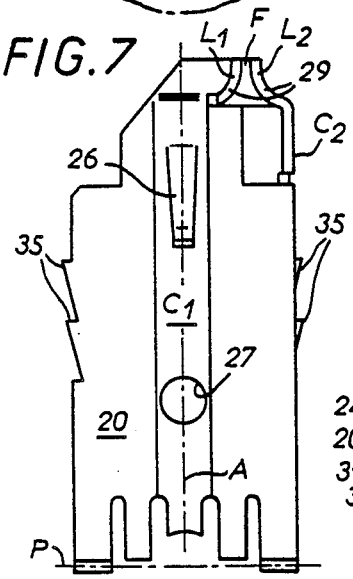
FIG. 7 is another view of it in axial cross-section at right angles to the previous cross-section, on the line VII—VII in FIG. 4.

When the connector is unstressed the floating shell member C2 of each of the elements E, E' constituting the contact member 11 is, as shown in FIG. 4, for example, subject to prestressing such that in the unstressed configuration of the connector it is nearer the other shell member C1 at its free end 21 than along its root generatrix G.

In this case, and as shown in FIG. 10 in particular, the corresponding lips L1, L2 are in the unstressed configuration of the connector in contact with each other at the point of the V-shaped inlet 31 that they form, gradually moving apart beyond the latter.

At assembly time the contact member 11 is first fitted from below onto a template so as to open the two slits F that it incorporates.

The barrel member 12 is then offered up axially in line with the contact member 11 with each of its tubular extensions 48 in line with the respective free space 24 between the free end 21 of the floating shell member C2 and the corresponding flange 20.

Its thin wall 46 is then inserted between the lips L1, L2 of the slits F in the contact member 11 while the free spaces 24 formed in the latter enable the accompanying entry of its tubular extensions 48.

When this axial insertion has been completed the barrel member 12 is rotated on itself through a few degrees about the axis A of the connector and its tubular extensions 48 then become inserted circumferentially between the corresponding shell members C1, C2 of the contact member 11 beneath the narrower parts 29 through which the shell members C1, C2 merge with the lips L1, L2 that they form.

Immediately its tubular extensions 48 are circumferentially inserted in this way beneath the narrower parts 29 the barrel member 12 is held axially relative to the contact member 11.

The template previously fitted is then removed and the combination formed by the contact member 11 and the barrel member 12 is then force fitted into the housing 16 in the insulative material body 10 until it reaches a specific position in which the barbs 35 on the contact member 11 anchor this assembly into the wall of the housing 16.

It is therefore through the intermediary of the contact member 11 that the barrel member 12 is held axially relative to the insulative material body 10.

Of course, snap-fastener means may be provided if necessary between it and the insulative material body 10 to procure systematically individual axial retention.

For example, there could be provided on the outside surface of the shank 38 of the barrel member 12 a projecting annular bead adapted to snap into a corresponding groove on the inside surface of the housing 16 of the insulative material body 10.

In the unstressed configuration at least of the connector there is peripheral clearance J between each floating shell member C2 of the contact member 11 and the insulative material body 10, to be more precise the inside wall of the housing 16 in the latter.

Abutment or other means may be provided between the barrel member 12 and the insulative material body 10 to enable marking of the angular position of the barrel member 12 for which its tubular extensions 48 extend into the free spaces 24 of the contact member 11 away from the corresponding slits F.

It is in this angular position of the barrel member 12 that it is possible to insert into at least any one of the holes 45 in the latter an electrical conductor 13 to which a connection must be made, whether this is a so-called "rigid", that is solid-core, conductor or a multistrand conductor.

Figure 8:
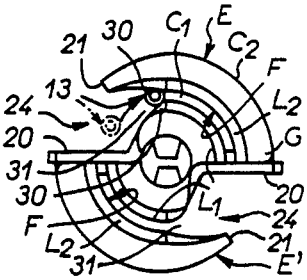
FIG. 8 is a plan view of this contact member analogous to that of FIG. 4 and corresponding to a stressed configuration thereof.

As shown schematically in dotted outline in FIG. 8 the electrical conductor 13 extends substantially parallel to the axis of the connector through the hole 45 into which it is inserted and the corresponding opening 47 in the thin wall 46 and the tubular extension 48 which follows on therefrom and is spaced from the corresponding slit F in the contact member 11.

When the barrel member 12 is rotated in the corresponding direction the conductor is constrained by the corresponding edge of the opening 47 in the thin wall 46 of the barrel member 12 to move in the direction of the arrow F in FIG. 8 and as shown in full line in this figure towards the V-shaped inlet 31 to the slit F concerned of the contact member 11.

Figure 18:
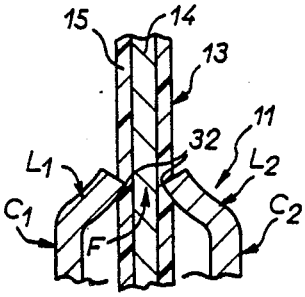
FIGS. 18 and 19 are views in axial cross-section respectively relating to those of figures 9 and 10, showing how the contact member that the insulation displacement connector in accordance with the invention comprises functions.
Figure 19:
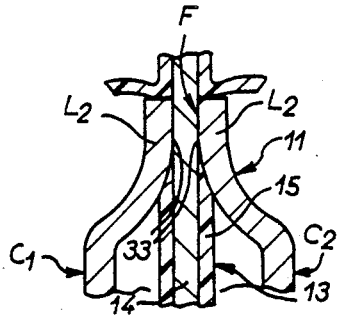

It then comes into contact with the sharp edge 32 formed in the V-shaped inlet 31 by each of the lips L1, L2 defining the slit F concerned; given the oblique arrangement of the lips L1, L2 along the V-shaped inlet 31, the sharp edges 32 of the lips L1, L2 cuts into the insulative sheath 15 of the electrical conductor 13, as shown in FIG. 18, and because of their oblique disposition and their offset edge they displace the insulative sheath 15 locally, as shown in FIG. 19, and cause progressive movement of the lip L2 away from the lip L1. This is by virtue of elastic deformation of the floating shell member C2 incorporating the lip L1, in particular through elastic rotation of the floating shell member C2 about the bending line materializing over part of its height its root generatrix G.

It will be readily understood that this elastic deformation of the floating shell member C2 is possible because of the clearance J.

Beyond the V-shaped inlet 31, and as shown in FIG. 19, it is then the cylindrical surface 33 of the lips L1, L2 that bears against the previously bared conductive core 14 of the electrical conductor 13, being advantageously tangential to the latter at this time.

The required connection is then made.

The electrical conductor 13 may be disconnected, if required by reverse rotation of the barrel member 12.

When as previously mentioned another electrical conductor is connected to the contact member 11 at its base the electrical conductor when plugged into the contact member 11 is electrically connected by the latter to that other electrical conductor.

However, the insulation displacement connector in accordance with the invention may equally well be used to interconnect electrically two electrical conductors each inserted into a respective one of the two holes 45 in its barrel member 12.

As a result of the arrangements described so far the capacity of a floating shell member C2 for elastic deformation on which depends the contact pressure exerted on an electrical conductor 13 by the lips L1, L2 of a slit F at any point in the latter may advantageously be controlled not only by its thickness but also by modifying appropriately one or other of the geometrical parameters concerned, in particular one or other of the geometrical parameters constituting the previously defined heights H1, H2, H3 for a floating shell member C2 of this kind.

Figure 11:
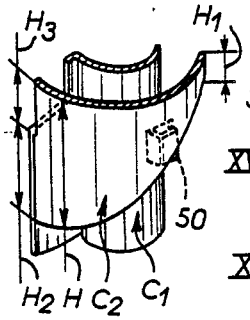
FIG. 11 is a partial schematic view of it in perspective and transverse cross-section.
Figure 13:
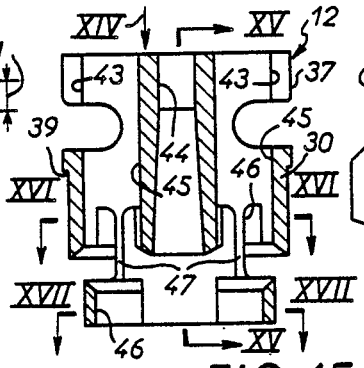
FIG. 13 is a view in axial cross-section of the barrel member that the insultion displacement connector in accordance with the invention also comprises.
Figure 14:
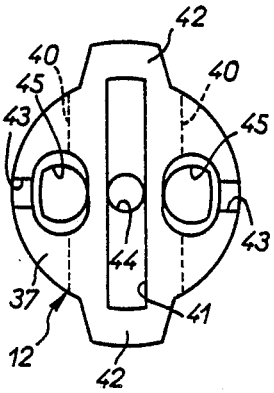
FIG. 14 is a plan view of this barrel member in the direction of the arrow XIV in FIG. 13.
Figure 15:
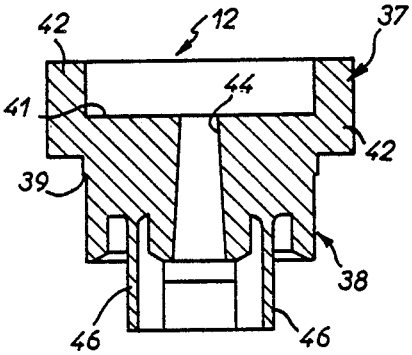
FIG. 15 is another view of it in axial cross-section on the line XV—XV In FIG. 13.
Figure 16:
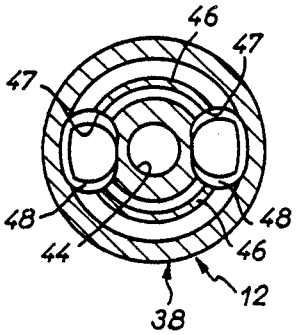
FIGS. 16 and 17 are view of it in transverse cross-section on the lines XVI—XVI and XVII—XVII, respectively, in FIG. 13.
Figure 17:
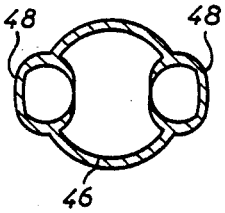

As schematically represented in dashed outline in FIG. 11, a floating shell member C2 of this kind may comprise at least one localized projecting tang 50 through which it bears against the inside wall of the housing 16 in the insulative material body 10, which locally modifies the elasticity conditions to provide a further control parameter.

Figure 20:
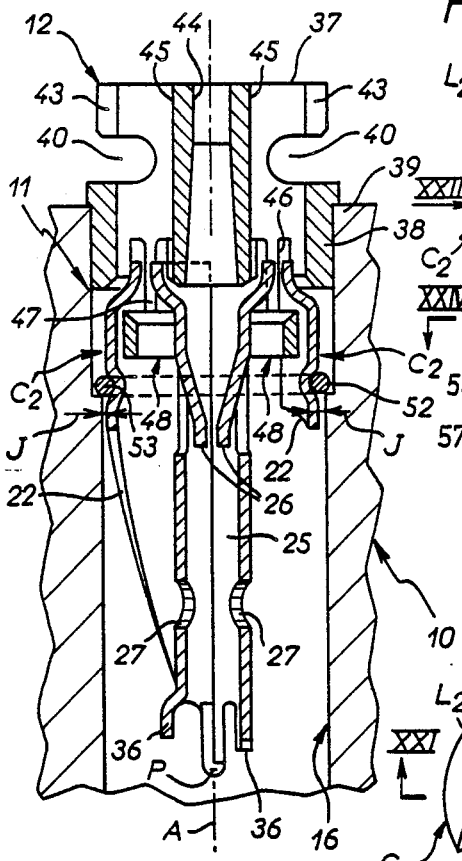
FIG. 20 is a partial view in axial cross-section analogous to that of FIG. 1 relating to another embodiment of the insulation displacement connector in accordance with the invention.
Figure 21:
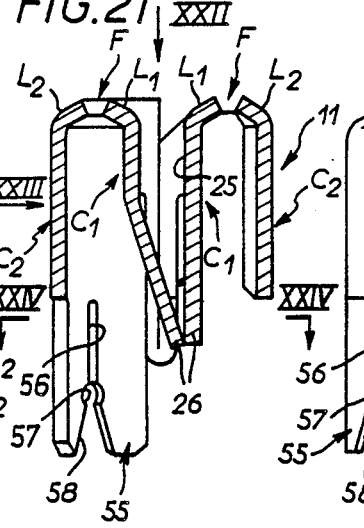
FIG. 21 is a view in axial cross-section on the line XXI—XXI in FIG. 22 of another embodiment of the contact member of the insulation displacement connector in accordance with the invention.
Figure 23:
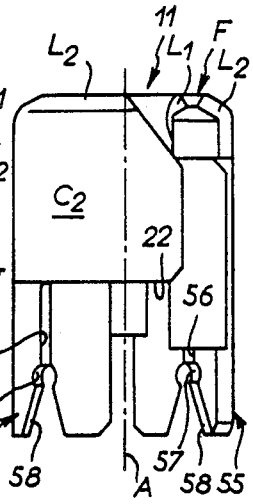
FIG. 23 is a view of it in elevation in the direction of the arrow XXIII in FIG. 21.
Figure 22:
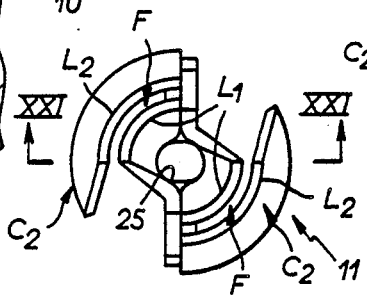
FIG. 22 is a plan view of this contact member in the direction of the arrow XXII in FIG. 21.

In the embodiment shown in FIG. 20 the contact member 11 is made such that in the unstressed configuration of the connector the floating shell member C2 of its elements E, E' is not prestressed, so that the slits F are then not closed, but to the contrary open at the same end as its free spaces 24.

The barrel member 12 may then be rotated without effort when it is fitted into the contact member 11, even without using a template.

The contact pressure at the lips L1, L2 of the slits F is accommodated in this case by the action of an annular ring 52 disposed to this end around the contact member 11 on the floating shell member C2 of the elements E, E' by means of an annular groove 53 provided on the surface of the floating shell member C2; in the absence of any electrical conductor this holds said lips L1, L2 pressed against either the thin wall 46 of the barrel member 12 with clearance at the tubular extensions 48 thereof or the tubular extensions 48 with clearance at said thin wall 46.

The housing 16 in the insulative material body 10 is stepped to enable insertion of the annular ring 52 into its wider upper part and the shank 38 of the barrel member 12 is made thicker to bear against said insulative material body 10.

The embodiment shown in FIGS. 21 through 25, which concern only the contact member 11, incorporates various modifications.

These are essentially as follows:

Firstly, the edge 22 of each floating shell member C2 opposite its lip L2 is straight, lying in a transverse plane substantially perpendicular to the axis A of the connector.

Also, the lips L1, L2 of each slit F originate directly from the corresponding shell members C1, C2 without the latter having any narrower parts and extend obliquely relative to each other over the full length of the slit F concerned, moving towards each other as they move away from the shell members C1, C2 from which they originate.

Also, the tangs 26 cut out from the shell members C1 from which the inner lips L1 originate extend freely to the base of the shell members C1.

One of these tangs 26 is straight and the other is deflected obliquely towards the first, so projecting as previously into the corresponding central tubular receptacle 25.

Finally, in this embodiment instead of the tangs 36 at least one of the shell members C1, C2 is extended downwardly, that is in the direction away from the lips L1, L2, by a connecting lug 55 in the central part of which is a downwardly open axial slit 56.

The slit 56 incorporates a localized wider part 57 with a circular contour and from this its lips diverge from each other in the direction towards its outlet, together forming a wide V-shaped inlet 58.

In practise the shell member C1, C2 which is extended downwardly in this way by a connecting lug 55 is the floating shell member C2.

The two floating shell members C2 that the contact member 11 comprises are in practise each extended downwardly by a connecting lug 55 and the slits 56 in the two connecting lugs face each other in diametrally opposed positions relative to each other with their wider parts 57 at the same level.

Figure 24:
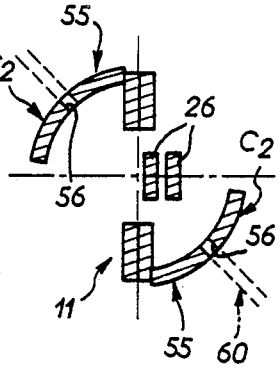
FIG. 24 is a view of it in transverse cross-section on the line XXIV—XXIV in FIG. 21.
Figure 25:
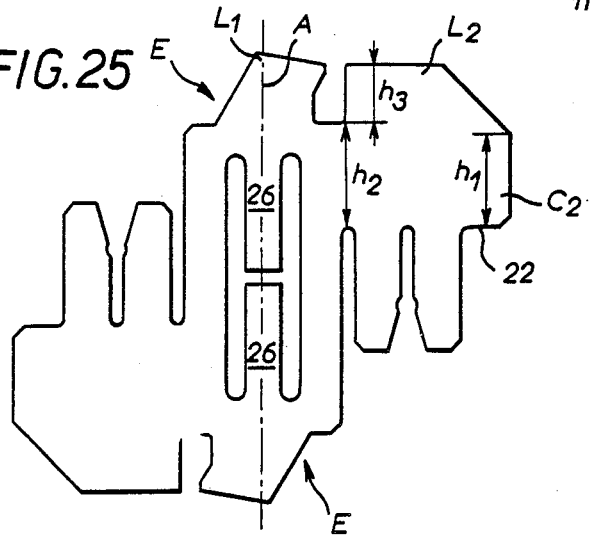
FIG. 25 is, like FIG. 12, a plan view to a smaller scale of a blank from which this contact member is formed.
Figure 26:
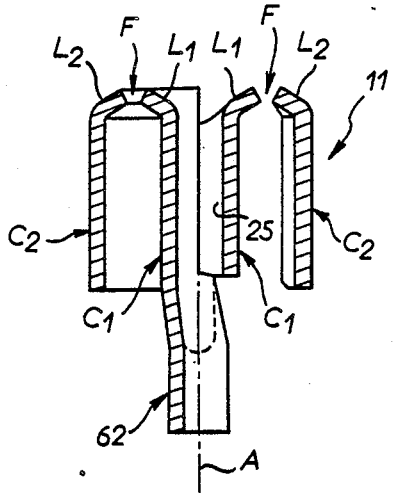
FIGS. 26 through 29 are views respectively analogous to FIGS. 21 through 24 relating to another embodiment of this contact member.
Figure 28:
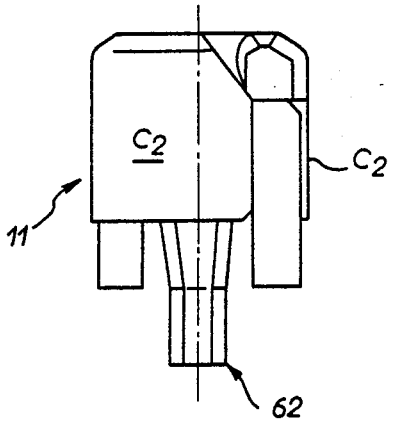
Figure 27:
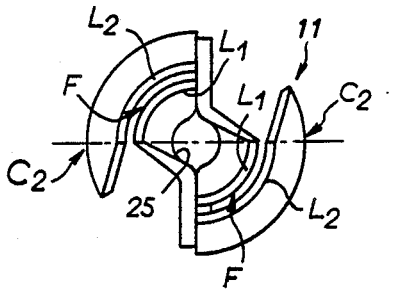
Figure 29:
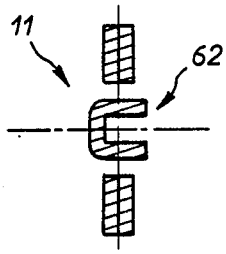

As schematically represented in dashed outline in FIG. 24 the two connecting lugs 55 advantageously enable connection to the contact member 11 of an appropriately bared electrical conductor 60, possibly by simple snap-fastener action.

The electrical conductor 60 then extends diametrally from one of the floating shell members C2 to the other below the tangs 26.

Experience shows that even if this stiffens slightly the floating shell members C2 at their base it does not in any way compromise their capacity for elastic deformation at the level of the lips L1, L2 of the slits F.

The connection of the electrical conductor 60 is more secure in that it involves two contact areas instead of one.

Also, as these contact areas are offset from each other the seating of the connector onto the electrical conductor 60 concerned is made firmer.

Finally, as these contact areas are operative at a level lower than the base of the tubular receptacle 25, there is no risk of interference with any contact member descending into the latter, such as the lead of an electrical component, for example.

The other arrangements are as previously described.

In the embodiment shown in FIGS. 26 through 29 instead of the previous connecting lugs 55 one of the floating shell members C1, C2 is extended downward by a connecting foot 62.

The connecting foot 62 is U-shaped in transverse cross-section with its concave side facing towards the axis A of the connector and only one shell member C1, C2 is extended downwardly by a connecting foot 62 of this kind.

This is the shell member C1, that is to say the shell member of which the inner lip L1 of the corresponding slit F forms part.

The connecting foot 62 extends to the base of the tubular receptacle 25.

The remaining arrangements are as described with reference to FIGS. 21 through 25 except for the presence of the tangs 26 in the tubular receptacle 25.

Figure 30:
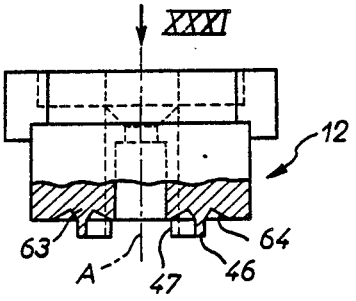
FIG. 30 is a view partially in elevation and partially in axial cross-section of another embodiment of the barrel member that the insulation displacement connector in accordance with the invention comprises.
Figure 31:
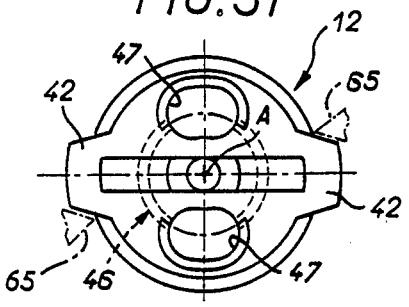
FIG. 31 is a plan view of this barrel member in the direction of the arrow XXXI in FIG. 30.

In the embodiment shown in FIGS. 30 and 31, which concern the barrel member 12, the circular thin wall 46 that the barrel member 12 comprises at its base does not have any extension.

Its height is limited but sufficient to extend beyond the lips L1, L2 of the slits F through which it has to pass.

The height of the thin wall 46 is in practise made sufficient for its free edge to be substantially level with the point at which the lips L1, L2 merge with the shell members C1, C2 from which they originate.

The thin wall 46 of the barrel member 12 is profiled at its root in the same way as the lips L1, L2 and the same applies to the lower surface of the barrel member 12.

In other words the thin wall 46 has at its root an increased thickness 63 with a trapezium-shaped profile in axial cross-section, the shorter parallel side corresponding to the cross-section of its main part and the longer parallel side corresponding to its merging with the lower surface of the barrel member 12.

This lower surface conjointly comprises to either side of this thickening 63 of the thin wall 46 a recess 64 which is trapezium-shaped in cross-section with a shorter parallel side forming its base corresponding to the longer parallel side of the thickening 63 of the thin wall 46 and a longer parallel side forming its outlet.

The openings 47 in the thin wall 46 of the barrel member 12 open freely at the base of the latter, that is to say on the edge forming its free end.

Other arrangements concerning the barrel member 12 are as previously described.

However, as schematically represented in dashed outline in FIG. 31 its lugs 42 may be used to lock it against rotation in one or other of the two angular positions corresponding to connection of and disconnection of an electrical conductor in a slit F.

To this end there are provided at diametrally opposite positions on the insulative material body 10 two projecting pegs 65 with which the lugs 42 of the barrel member 12 interfere when it is rotated about the axis A of the connector.

It is to be understood that the present invention is not limited to the embodiments described and shown but encompasses any variant execution and/or combination of their various component parts.

In particular, the contact member of the insulation displacement connector in accordance with the invention may incorporate only one connection slit.

We claim:

1. An insulation displacement connector comprising an insulative material body and in said body a generally tubular metal contact member including inner and outer part-cylindrical shell members, said outer shell member being a floating shell member and extending circumferentially in cantilever fashion from a root generatrix, said floating shell member being elastically radially deformable relative to the root generatrix between a radially inward position in an unstressed condition of said connector and a radially outward position in a stressed condition of said connector, said inner and outer shell members having respective inner and outer lips, a slit being defined between said inner and outer lips and extending around at least part of the circumference of said contact member, and a barrel member rotatable about an axis of said connector and adapted to force an electrical conductor into said slit, there being peripheral clearance between said floating shell member and said insulative material body at least in the unstressed condition of said connector whereby the floating shell member permits the connector to accommodate electrical conductors of different diameters.

2. Connector according to claim 1, wherein said floating shell member is elastically deformable about said root generatrix in a radial direction and is prestressed so that in the unstressed configuration of the connector it is nearer the other shell member at its free end than along said root generatrix.

3. Connector according to claim 1, comprising an annular ring fitted around said contact member.

4. Connector according to claim 1, wherein over at least part of their circumferential length from said root generatrix said lips are parallel to the axis of the connector along their free edge.

5. Connector according to claim 1, wherein said barrel member comprises a circular thin wall whereby it extends axially into said slit and which includes an opening aligned with a hole provided for inserting an electrical conductor, which opening opens freely at the base of said thin wall.

6. Connector according to claim 1, wherein said floating shell member comprises at least one localized projecting tang means for bearing against a wall of said insulative material body and modifying elasticity conditions to provide a further control parameter.

7. Connector according to claim 1, wherein over at least part of its circumferential length said floating shell member has a dimension of height parallel to the axis of the connector which decreases in the direction towards its free end.

8. Connector according to claim 7, wherein said height dimension decreases in a regular way from said root generatrix to said free end.

9. Connector according to claim 8, wherein said height dimension has a non-zero value at said free end.

10. Connector according to claim 7, wherein said floating shell member extends freely over part of the height dimension of said root generatrix.

11. Connector according to claim 10, wherein said floating shell member extends freely at the lip that it forms.

12. Connector according to claim 10, wherein said connector further comprises a flange in one piece construction which is an integral part of said floating shell member, a bending line between said flange and the remainder of said floating shell member extends part way along the height.

13. Connector according to claim 1, wherein said lips are joined to the respective shell members of which they form part by a radial narrower part of each shell member which reduces the distance between them and at the free end of the floating shell member they are conjointly bevelled from the base of said narrower part.

14. Connector according to claim 13, wherein said narrower part through which a lip of said contact member joins onto the shell member of which it forms part has an axial extent of substantially one-quarter circle.

15. Connector according to claim 13, wherein said lips have a free edge which extends obliquely to the axis of the connector, starting from the end towards said free end of said floating shell member, and therebeyond lies in a plane transverse to said axis.

16. Connector according to claim 1, wherein said barrel member comprises over at least part of its circumference a circular thin wall whereby it extends axially into said slit and which includes an opening aligned with a hole provided for inserting an electrical conductor and an extension beyond said thin wall in the axial direction in the form of a tube section aligned with said hole.

17. Connector according to claim 16, wherein said extension is adapted to brace said floating shell member.

18. Connector according to claim 1, said connector further comprises a connecting foot means for an electrical conductor extending at least one of said shell members downwardly and a downwardly open axial slot in a center part of said foot.

19. Connector according to claim 18, wherein said slot has a localized widened part beyond which its lips diverge towards its outlet.

20. Connector according to claim 18, wherein said foot means is on said floating shell member.

21. Connector according to claim 18, wherein said contact member comprises two circumferentially elongate slits, both of said shell members are extended downwardly by a connecting foot and said slots face towards each other.

22. Connector according to claim 1, said connector further comprises connector foot means for an electrical conductor extending one of said shell members downwards.

23. Connector according to claim 22, wherein said foot means is U-shaped in transverse cross-section.

24. Connector according to claim 22, wherein said foot means extends from said inner shell members.

25. Connector according to claim 1, wherein said contact member comprises two circumferentially elongate slits and those of said shell members of which said inner lips form part together form a tubular receptacle coaxial with the axis of the connector.

26. Connector according to claim 25, said connector further comprises at least one elastically deformable tang projecting into said receptacle.

27. Connector according to claim 9, wherein said floating shell member disregarding the lip thereof is of generally trapezoidal-shaped contour in axial elevation.

* * * * *